United States Patent [19]

Leseberg

[11] 4,251,070

[45] Feb. 17, 1981

[54] SUPINE EXERCISE DEVICE

[76] Inventor: Helen M. Leseberg, 260 Rowayton Ave., Rowayton, Conn. 06853

[21] Appl. No.: 64,100

[22] Filed: Aug. 6, 1979

[51] Int. Cl.[3] ..... A63B 21/18

[52] U.S. Cl. ..... 272/126; 36/50; 272/68; 272/143

[58] Field of Search ..... 272/126, 137, 139, 94, 272/96, 93, 143; 128/84 C; 36/50, 110

[56] References Cited

U.S. PATENT DOCUMENTS

| | | | |
|---|---|---|---|
| 324,498 | 8/1885 | Surbaugh | 272/126 X |
| 785,639 | 3/1905 | Seidler | 272/126 |
| 1,490,363 | 4/1924 | Couplin | 272/126 |
| 1,618,273 | 2/1927 | Davidson | 272/139 |
| 2,097,376 | 10/1937 | Marshman | 272/139 |
| 2,467,943 | 4/1949 | Mikell, Jr. | 272/137 |
| 2,627,677 | 2/1953 | Kashian | 36/50 |
| 2,973,589 | 3/1961 | Rigsby | 36/50 X |
| 3,213,551 | 10/1965 | Krauss | 36/50 X |
| 3,215,429 | 11/1965 | Shaboo et al. | 272/137 |
| 3,256,015 | 6/1966 | Perrin | 272/137 X |

FOREIGN PATENT DOCUMENTS

| | | | |
|---|---|---|---|
| 494526 | 7/1953 | Canada | 272/126 |
| 411622 | 11/1966 | Switzerland | 36/50 |
| 459955 | 1/1937 | United Kingdom | 36/50 |

*Primary Examiner*—Richard C. Pinkham
*Assistant Examiner*—Arnold W. Kramer
*Attorney, Agent, or Firm*—H. Gibner Lehmann; K. Gibner Lehmann

[57] ABSTRACT

A supine exercise device adapted to develop strength in the leg, arm and chest muscles of the human body, comprising a pair of moccasin-like stirrups constituted of canvas or heat cloth, for cradling the feet respectively. Each stirrup has a pair of pull cords emanating from a saddle portion above the instep of the foot and leading to hand grip bars, which latter are adapted to be grasped one in each hand. The pull cords extend on opposite sides of the legs and pass through tunnel formations of the stirrups, so as to cause the latter to conform to the sides and heel portions of the foot. The pull cords also pass through apertured flexible tabs which are securely attached to the fabric of the stirrup to withstand appreciable strain. The forward portion of the stirrup is gathered by pull which is exerted on the pull cords, and wrinkles somewhat to conform to the contour of the front of the foot. The user inserts his feet into the stirrups, and grasps the hand grip bars while in a supine position, working the pull cords so as to simulate bicycling movements of the legs.

7 Claims, 6 Drawing Figures

SUPINE EXERCISE DEVICE

BACKGROUND

This invention relates to personal exercise devices, and more particularly to devices of this type as designed for developing the leg, arm and chest muscles of the human body while the latter is in a supine or lying position.

In the past numerous exercise devices have been proposed and produced, with the intention of improving the muscle tone, circulation etc. of the human body. In many cases such devices were confined to working with a specific group of muscles, such as the leg muscles, or else the arm muscles, or the back muscles and the like. In some instances the devices were motorized, involving somewhat heavy equipment. Other devices, if not motorized, were still cumbersome and bulky, having sturdy structural shapes or forms of steel or other rigid material.

In general, most exercise devices were developed after a period of experimentation, and therefore they operated satisfactorily to improve the muscle tone, circulation etc. in the manner intended.

However, in a large number of instances the exercise devices required extra space, and represented an appreciable expense, in many cases with maintenance. This placed the device beyond the reach of the average person, who usually does not have the necessary space available, nor for that matter the means for purchasing and maintaining the equipment. Most often the device will be used only for a limited time, and in such circumstances it is undesirable to make the outlay of money and time that is required.

The foregoing considerations represent real and tangible drawbacks and disadvantages, when considered by the lay person in average circumstances.

SUMMARY

The above drawbacks of prior exercise devices are obviated by the present invention, which has for one object the provision of a novel and improved exercise device which is especially small and compact, requiring but little space, and which is at the same time particularly inexpensive whereby the average person can readily acquire and use the device with benefit.

Another object of the invention is to provide an improved exercise device in accordance with the foregoing, which is adaptable for use by persons of all ages, particularly those in the upper-age group, since the movements involved are not especially strenuous and are not likely to unnecessarily tax the strength and energy of the user.

A feature of the invention resides in the provision of an improved and simplified exercise device as above set forth, which can be placed in operation when the user is in a supine position, as for example while lying on a floor, bed or other suitable support.

Another feature of the invention resides in the provision of a simplified exercise device as characterized, which is especially well adapted to simultaneously develop the leg and arm muscles, as well as the muscles of the chest and back.

Still another feature of the invention resides in the provision of a novel exercise device of the type indicated, which is constructed mainly of non-metallic materials whereby it is light in weight while at the same time being especially sturdy and not likely to wear out or require maintenance.

The above objects are accomplished, in accordance with the invention, by providing a small, easily portable and carried, exercise device especially adapted for use with the hands and legs. The device comprises two separate, duplicate exercisers, each consisting of a hand grip and a sling means attached to the hand grip and consisting of a pair of pull cords which can extend away from the grip, both generally in the same direction. A novel moccasin-like stirrup constituted of canvas or heavy fabric is provided, attached to the remote portions of the pull cords and arranged so that it can closely conform to the bottom and side surfaces of a human foot to cradle the latter. The said pull cords are secured to opposite side portions of the stirrup, so as to straddle the foot of the user. The stirrup has an upstanding heel portion adapted to engage the back surface of the ankle of the foot and the heel thereof, and has opposite side portions which are engageable with the sides of the foot. The piece of fabric or canvas has a tunnel in the side edge portions, in which the pull cords are disposed, the arrangement being such that as the pull cords experience tension they will shape the fabric about the user's foot, pulling up heel portions and gathering together front portions so as to form a moccasin-like shape. The pull cords extend from the stirrup at a point somewhat forward of the instep of the foot, resulting in a balanced pull which enables the user to exert a lifting or pulling force on the foot and leg while in the supine position and grasping the hand grip. With two exercisers in place, the user can manipulate the cords in such a way as to cause the legs and feet to execute various movements, such as a bicycling movement, etc. and in so doing the muscles of the hands, arms and chest come into play, promoting development of these.

Still other features and advantages will hereafter appear.

In the accompanying drawings, illustrating an embodiment of the invention and a modification thereof:

Figure 1:
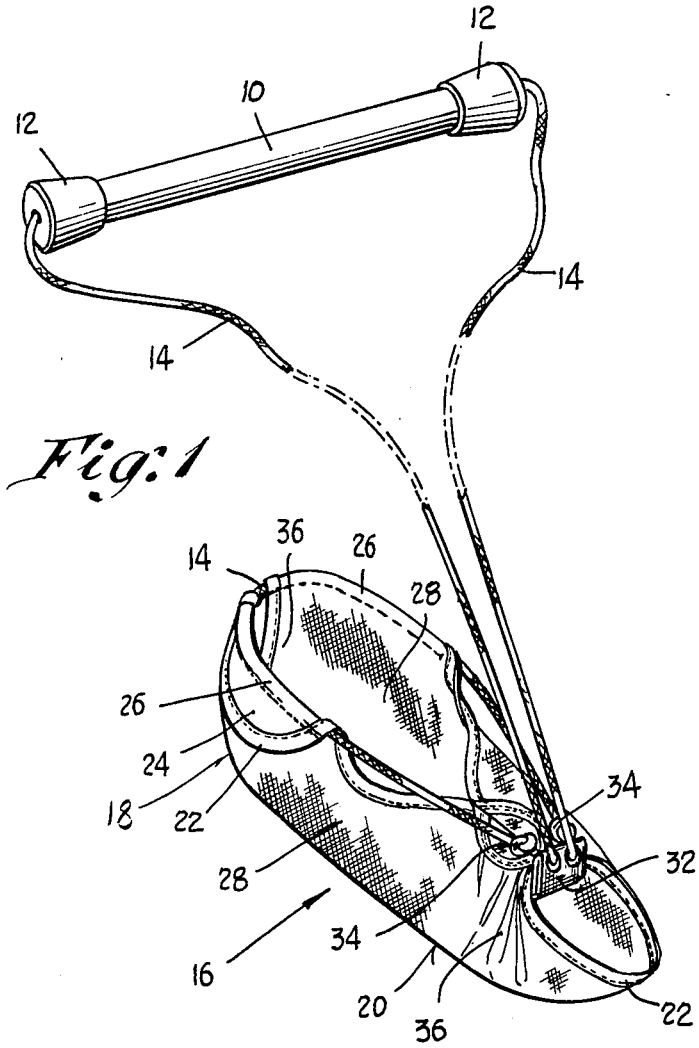
FIG. 1 is a perspective view of the exercise device as provided by the invention.
Figure 2:
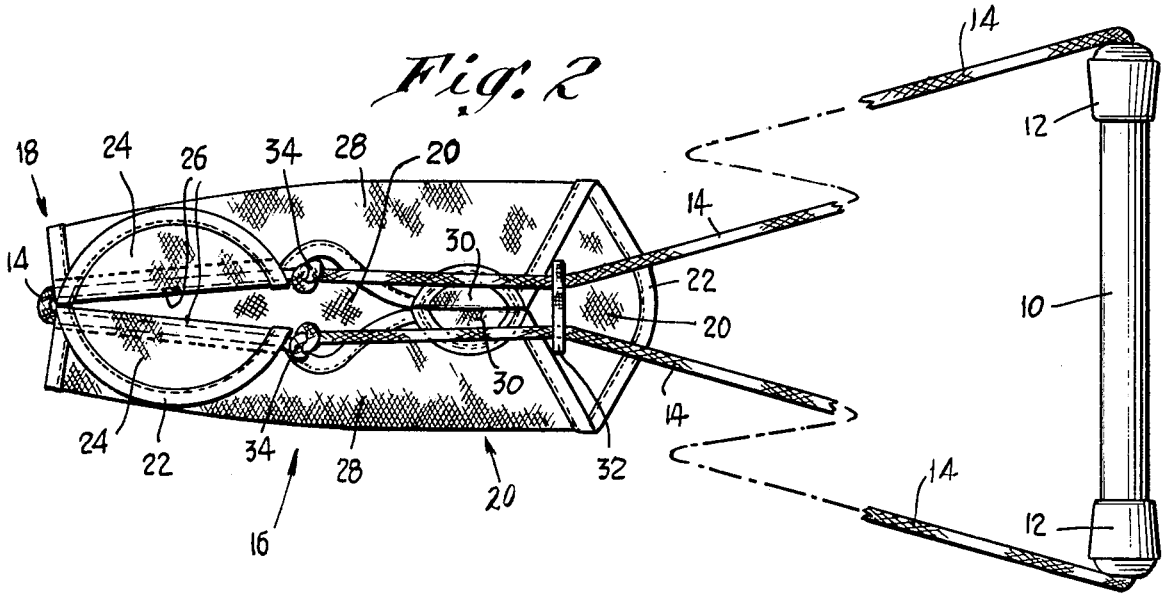
FIG. 2 is a top, plan view of the exercise device.

Referring first to FIGS. 1 and 2, each exercise device is seen to comprise a rigid hand grip bar 10 which carries end fittings 12 at its extremities for the purpose of securing in place a sling means comprising a pair of pull cords or cord parts 14, 14. The end fittings 12 can be constituted of resilient material, such as firm rubber, and the hand grip bar 10 can be advantageously formed of a plastic tube.

For use with the hand grip bar and pull cords, each exerciser has a moccasin-like stirrup 16 which is constituted mainly of a single piece of canvas or heavy cloth, cut on a bias. The bias disposition of the warp and weft threads is indicated in FIG. 2, by the areas of shading, and facilitates the shaping of the stirrup.

The stirrup 16 has a heel portion 18 and a sole portion 20, and all of the edges of the fabric are finished by a suitable binding, such as that indicated at 22. The heel portion includes a pair of semi-circular cuffs 24 which form tunnels 26 adapted to accommodate the pull cords 14. Suitable stitching is utilized to define the tunnels and also to secure the semi-circular cuffs to the side portions 28 of the stirrup, as shown.

The stirrup has additional but smaller, forwardly disposed cuffs 30 on the upper section, above the sole portion 20.

At its front, adjacent the smaller cuffs 30 there is secured to the upper of the stirrup 16 a pull tab 32 having a pair of apertures carrying eyelets, through which the pull cords 14 extend. Preferably, the pull cords 14 have knots 34 so located as to engage the rear side of the pull tab 32 after the pull cords 14 have drawn up and shaped or octinated the upstanding heel portions 36 and side cuffs 24 and portions 28 of the stirrup, as clearly illustrated in FIG. 1 whereby the side portions 28 are caused to engage the sides of the foot. When the stirrup is in the flat position, the knots 34 are spaced from the pull tab 32, as seen in FIG. 2.

During the forming of the stirrup as the pull cords 14 are tensed, the forward side portions 36 of the stirrup become gathered or wrinkled in the shaping of the front of the stirrup, as seen in FIG. 1.

Figure 3:
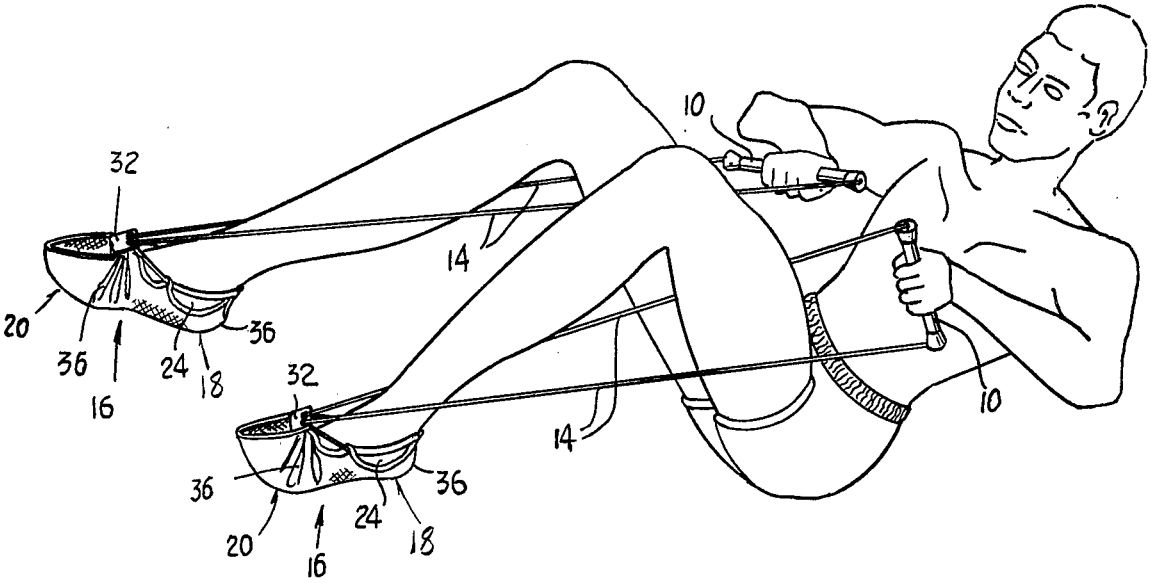
FIG. 3 is a diagrammatic illustration, showing the use of two such exercise devices.

The configuration of the stirrup as viewed in FIG. 1 is such as to cradle the foot of a user comfortably, this being illustrated in FIG. 3 which also shows how the exercisers are used. The user, while in the supine position on a floor or bed surface or the like, grasps the hand grip bars 10 with the stirrups 16 placed on the feet, and exerts pulling forces in a manner to enable the legs to be more easily raised, and to go through the various exercise movements. In doing this, the user not only utilizes the leg muscles, and arm and chest muscles, but also uses abdominal muscles as well. Since the entire body is in one type of movement or another, many other muscles are also utilized, including the neck muscles, back muscles etc. and therefore the exercisers can have an extremely beneficial effect in improving muscle tone, circulation etc. while at the same time minimizing strenuous use of any one set of muscles to the exclusion of others.

At the cuffs 30, the upper, frontal portion of the stirrup is secured together at the time that the pull tab 32 is being attached, this also preferably being done by stitching.

It will now be understood from the foregoing that I have provided a novel and unique pair of exerciser devices which can be especially economically fabricated, which are small and compact requiring but little storage space, light in weight, and which can be conveniently used to develop the muscles and improve the circulation of the human body. No heavy or metallic components are involved, and the exercisers are especially sturdy and not likely to malfunction or require maintenance.

Figure 4:
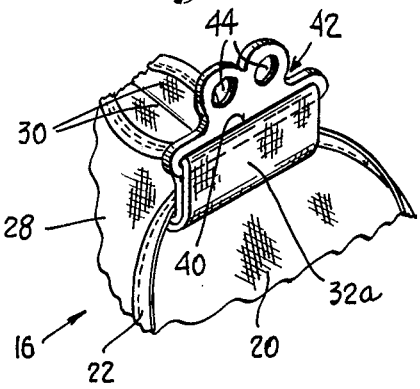
FIG. 4 is a fragmentary perspective view showing a modified form of pull tab arrangement of the device
Figure 5:
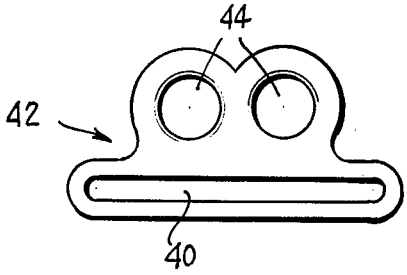
FIG. 5 is a plan view of a buckle member, as utilized in the device of FIG. 4.

A modification of the invention is illustrated in FIGS. 4 and 5 wherein a pull tab 32*a* passes through the slot 40 of a small metallic buckle 42 which has apertures 44 to accommodate the pull cords 14. In some respects, the provision of the buckle 42 of FIGS. 4 and 5 results in an economy of manufacture, being somewhat simpler than the eyelets which are applied to the pull tab 32. In either case, the pull tab can be considered as having means engageable with the pull cords 14, for transferring pull therefrom to the side edge portions 28 of the stirrup 16.

Figure 6:
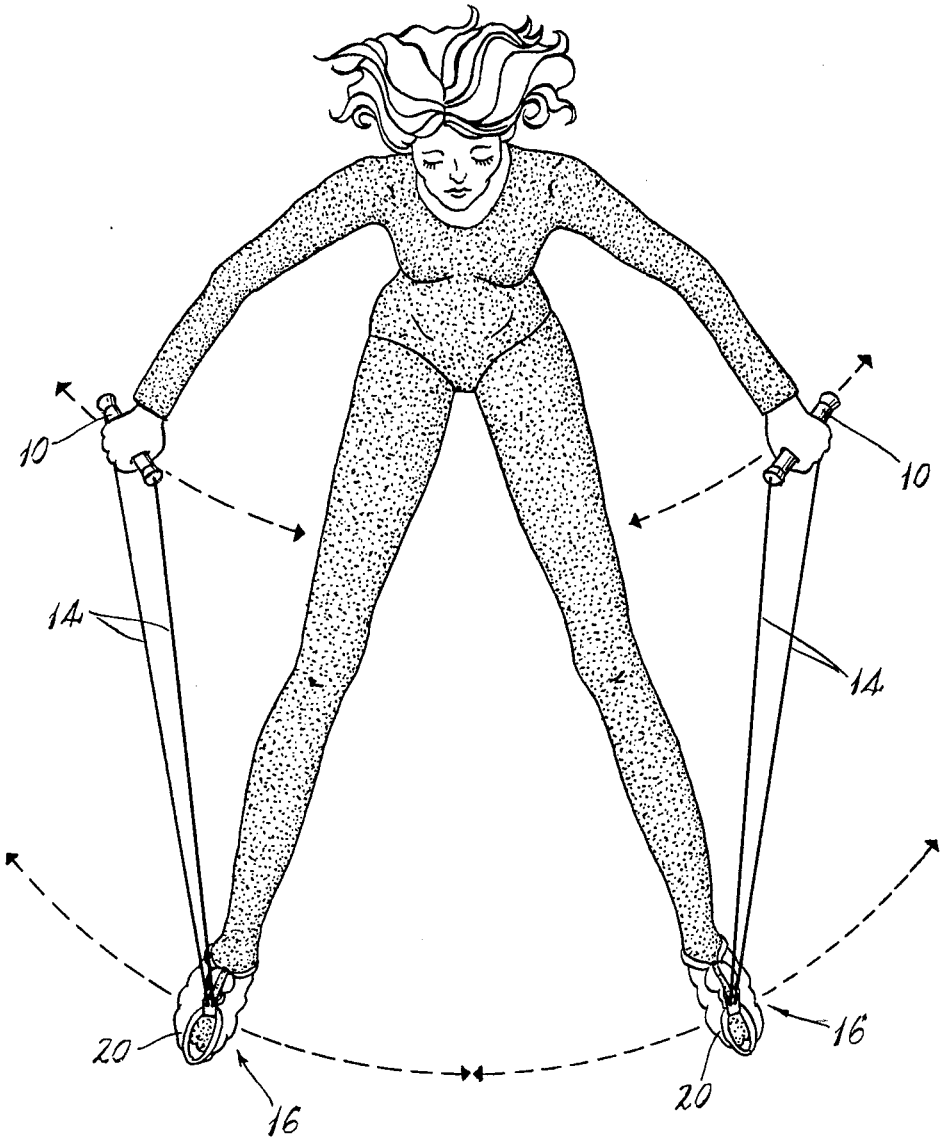
FIG. 6 is a diagrammatic illustration in the form of a top plan view of a person in supine position, using the exercise device of the invention.

FIGS. 3 and 6 clearly illustrate how the exercise device can be used. The user employs the arm muscles and leg muscles in various ways to control the arm and leg movements and positions, so as to achieve either isometric, isotonic or aerobic benefits. The two exercise devices can thus develop strength, mobility and endurance while the user is in the most relaxed position, with the body flat on its back. With the hands placed in the centers of the handles, the knees will be automatically guided through the cords, in alignment with the large toes. This tends to effect an even and uniform muscle development. The handles 10 are sized so that each can accommodate two hands, if it is desired to exercise only one leg at a time.

As stated above, the exercisers can be employed for carrying out three types of exercises, specifically as follows: Isometric, where the muscles are tensed without motion, in resistance to each other or to an object as for example when a continuous squeeze is exerted on the handle after the fingers grip and close around it. In carrying this out a muscle influence can be felt from the closed hand to the elbow. With the continuous squeeze exercise, the grip is relaxed after a count of three. The isotonic exercises involve tensing of the muscles in slow motion against each other or against an object. The leg muscles will resist the arm muscles, for example. For the aerobic exercises more rapid movements are employed, for stimulating heart and lung action, as occurs in bicycling and swimming.

The improved exercisers of the invention utilize the principle of exercising while lying flat on the back or in a supine position, and provide the advantage that occurs when muscles are developed and strengthened around a relaxed body frame, thus affording greater ease of movement during later activity with the body in an upright position.

The exercisers make possible the tensing and relaxing of muscles with either mild or strong, shallow cycle-type motions of the legs and arms, or else greater stretching-type movement involving more mobility and deeper vigorous cycle motions, these constituting an aerobic exercise for speed and endurance. The isotonic exercisers are used for strengthening the inner leg and arm muscles, and also for strengthening the abdominal, diaphragm, chest and neck muscles. In doing this, the user pulls up from a flat position. (In the case of weak muscles, the user rocks up until the muscles are stronger). Also, a slight side roll can render a slimming influence of upper, outer thighs and hips. The stirrups 16 have been designed to allow isotonic exercises of the toe, heel and ankle muscles, as provided by the invention, and the hand grip bars 10 have removable end caps for cord adjustment.

Other variations and modifications are possible without departing from the spirit of the claims.

I claim:

1. An exercise device for humans, adapted for use with the human body in a supine position, comprising in combination:

(a) a hand grip, (b) pull-cord means attached to the hand grip and extending away therefrom generally in one direction, and (c) a flexible moccasin-like stirrup connected to the pull-cord means, (d) each of two opposite side portions of said stirrup being folded back on itself and secured, forming a tunnel, said pull-cord means extending through both said tunnels and causing said side portions to closely conform to the side surfaces of a human foot to cradle the latter, (e) said stirrup having a connector at its front, through which the pull-cord means passes, (f) said pull-cord means being movable lengthwise in said connector to enable it to activate said opposite side portions of the stirrup to cause said engagement thereof with said sides of the foot, and (g) means on said pull-cord means, for limiting the movement of the same through said connector, thereby to limit the said activation of the opposite side portions.

2. An exercise device as in claim 1, wherein:

(a) said stirrup has an upstanding heel portion adapted to engage the back surface of the ankle of the foot at the heel thereof.

(b) said upstanding heel portion having tunnels through which the pull-cord means passes.

3. An exercise device as in claim 1, wherein:

(a) said connector comprises a pull tab secured to said side portions, (b) said tab having openings through which the pull-cord means passes, for transferring pull therefrom to said side portions.

4. An exercise device as in claim 3, wherein:

(a) said tab has eyelets in the openings, engageable with the pull-cord means where thelatter passes through the pull tab.

5. An exercise device as in claim 3, wherein:

(a) said limiting means on the pull-cord means comprises knots adapted to engage the pull tab when the pull-cord means is tensed.

6. An exercise device as in claim 1, wherein:

(a) said connector which is engageable with the pull-cord means comprises a pull tab and a buckle that is carried by the pull tab and has openings through which the pull-cord means passes.

7. An exercise device as in claim 1, wherein:

(a) the stirrup is of fabric, and the warp and weft threads of the fabric are bias-disposed to facilitate the shaping of the stirrup.

* * * * *